United States Patent [19]

Yonezawa et al.

[11] 4,165,964

[45] Aug. 28, 1979

[54] VERTICAL DIRECT FIRED STRIP HEATING FURNACES

[75] Inventors: Toshiya Yonezawa; Katsuyoshi Kobayashi, both of Kitakyushu, Japan

[73] Assignee: Nippon Steel Corporation, Tokyo, Japan

[21] Appl. No.: 841,322

[22] Filed: Oct. 11, 1977

[30] Foreign Application Priority Data

Oct. 27, 1976 [JP] Japan ..... 51-129966

[51] Int. Cl.[2] ..... F27B 9/28

[52] U.S. Cl. ..... 432/59; 266/102; 432/65

[58] Field of Search ..... 432/8, 59, 242, 65; 266/102, 103, 108

[56] References Cited

U.S. PATENT DOCUMENTS

| | | | |
|---|---|---|---|
| 2,009,856 | 7/1935 | Otis et al. | 266/102 |
| 2,499,191 | 2/1950 | Jones et al. | 432/59 |
| 3,421,746 | 1/1969 | McCoy | 432/59 |
| 3,532,329 | 10/1970 | Bloom | 432/59 |
| 3,837,790 | 9/1974 | Pierson | 432/8 |
| 3,857,673 | 12/1974 | Andrus | 432/59 |

*Primary Examiner*—John J. Camby

*Attorney, Agent, or Firm*—Wenderoth, Lind & Ponack

[57] ABSTRACT

A vertical strip heating furnace includes at least two vertical direct fired heating chambers which are arranged in parallel which are communicated with each other. A separation chamber for housing inside furnace rolls at adjacent pairs of the chambers is provided in at least one location. The inside furnace rolls are separated from the main flow of the combustion gases and the temperature of the atmosphere in the chambers housing the inside furnace rolls is adjusted to within a fixed range. This strip heating furnace is capable of large capacity processing and is designed to save energy, and the inside furnace rolls are free from breakage due to thermal stress.

6 Claims, 3 Drawing Figures

VERTICAL DIRECT FIRED STRIP HEATING FURNACES

BACKGROUND OF THE INVENTION

This invention relates to vertical direct fired strip heating furnaces in continuous annealing furnaces for heating steel strips.

Although it is a well known fact that a flame cleaning process is frequently used in a continuous zinc plating process, in this process, in the initial stage of the heating of the steel strip, in order to decompose and clean the rolling oil adhered to the surface of the steel strip, means for heating the steel strip in a slight oxidation atmosphere is employed, and in general, a furnace having a direct fired combustion heating system for partly burning the fuel is used.

The conventional vertical direct fired strip heating furnace of this kind has been constructed with one heating chamber, and this limits the processing capacity. The realization of a vertical direct fired strip heating furnace constructed with more than two heating chambers has been strongly demanded. Also, recent technical needs for energy savings have resulted in a strong demand for the realization of a vertical direct fired strip heating furnace provided with a plurality of passages which consists of more than two chambers.

In the conventional direct fired strip heating furnace, since it is of the one heating chamber construction, when the processing capacity is increased, due to a limit of the furnace height because of economic reasons, there is a limit in the heating temperature, and the extra load tends to be applied to the succeeding indirect heating reduction chamber. In case the processing capacity is increased too much, the temperature is limited to an extent which prevents the realization of the original process of flame cleaning. This is a big drawback of the conventional furnace. Also, when heating is done in one chamber, the combustion gases are exhausted at the furnace top portion, thus making the thorough utilization of exhaust gases difficult, and a gas sealing device provided at the opening portion for introducing the steel strip to the heating chamber must be constructed to widthstand the high temperature gases.

The technical concept of preheating the steel strip with combustion exhaust gases of the vertical direct fired strip heating furnace (as disclosed in U.S. Pat. No. 3,532,329) is known, but this technique is such that the preheating chamber and heating chamber for treating the steel strip by exhaust gases of the direct fired strip heating chamber are not communicated, namely, the steel strip passing the preheating chamber is exposed once to the atmosphere, and thereafter is introduced to the heating chamber. In this case, in order not to cause excessive oxidation of the surface of the steel strip exposed to the atmosphere, there are problems such as that the preheating temperature of the steel strip must be limited to a low temperature, and also that the gas sealing device at the opening portion for introducing the steel strip to the heating chamber is required to have a construction capable of withstanding the high temperature, similar to the situation in the conventional vertical direct fired strip heating chamber consisting of one chamber.

In the present invention, in order to solve the foregoing problems, more than two heating chambers are provided in communication. Heating chamber as mentioned herein means a direct fired heating chamber or a preheating chamber. With the foregoing arrangement, a sufficient heating temperature is secured to meet with the necessary processing capacity, and moreover the excessive oxidation of the surface of the preheated steel strip is prevented, the exhaust gas temperature from the preheating chamber is lowered to accomplish an energy saving, the thermal requirements for the gas sealing device at the opening portion for introducing the steel strip is relieved, and, an important thing to be noted here, the furnace is provided with a protection countermeasure for the rolls.

In general, the direct fired strip heating furnace whose primary purpose is to clean the surface of the steel strip by flame performs the flame cleaning process effectively, and also for the purpose of improving the heating efficiency, it is operated at high a temperature ranging from 1000° C.–1250° C. Accordingly, in order to use metal inside furnace rolls economically at such high temperatures, it is necessary to hold the temperature of the inside furnace roll chamber below at least 1000° C. Moreover, in the low temperature region where the temperature of the steel strip is not sufficiently high, then in order to prevent damage to the rolls due to thermal stress generated on the body of the rolls, adjustment of the temperature in the inside furnace roll chamber to a proper range is required.

When there is a big difference between the atmospheric temperature in the circumference of the rolls and the temperature of the passing steel strip, a big thermal stress occurs in the axial direction of the body of the rolls, and in the worst case, cracks may be caused to occur in the body of the rolls. Namely, the center portion of the body of the rolls contacting the low temperature steel strip is constantly cooled by the steel strip and as a result, there occurs an immensely large temperature difference between such center portion and the shoulder portion not contacting the cooled steel strip. According to actual measurement by the inventors, in case the temperature difference is large and may reach 350° C. to 400° C., and thermal stress sufficient to break down the body of the rolls a short time is generated. Normally, in order to hold the thermal stress generated on the body of the rolls to a degree that produces no actual damage from a practical standpoint, it is necessary to hold the atmospheric temperature in the roll chamber above the temperature of the passing steel strip or within temperatures of the steel strip temperature plus 500° C. In this regard, the reason for making the atmospheric temperature above the temperature of the passing steel strip is not to cool the steel strip in the roll chamber. To protect the rolls, water cooling jackets may be disposed in the circumference of the inside furnace rolls to cool the surfaces of the rolls, or the rolls may be cooled indirectly by disposing an air cooling pipe. However, these methods are accompanied by various problems such as danger of water leakage, dew condensation, only a slight cooling of the atmospheric gases in the circumference of the inside furnace rolls, as well as the fact that the inner surface of the body of the rolls is heated by the radiating gases of high temperature filled in the inner surface of the inside furnace rolls, and in addition to thermal stress in the axial direction, a temperature difference is generated between the inner and outer surfaces of the cylinder of body of the rolls to increase the thermal stress in the radial direction.

SUMMARY OF THE INVENTION

An object of the present invention is to provide a vertical direct fired strip heating furnace which is capable of large capacity processing and of saving energy.

Another object of the present invention is to provide a vertical direct fired strip heating furnace that protects the rolls provided in the furnace from high temperature combustion gases and that is capable of preventing damage to the rolls.

A further object of the present invention is to provide a vertical direct fired strip heating furnace of large capacity and requiring less installation space.

In order to accomplish the foregoing objects, the present invention is characterized in that a furnace proper is formed by more than two heating chambers which are disposed in parallel and which are communicated with each other. A separation chamber for accommodating the inside furnace rolls at adjacent pairs of parallelled chambers is provided in at least one location (in general, at one location less than the number of the parallell chambers). The inside furnace rolls are separated from the main flow of the combustion gases, and the inside furnace rolls are protected by adjusting the atmospheric gas temperature of the roll chambers to within a fixed range.

DESCRIPTION OF THE PREFERRED EMBODIMENTS

Figure 1:
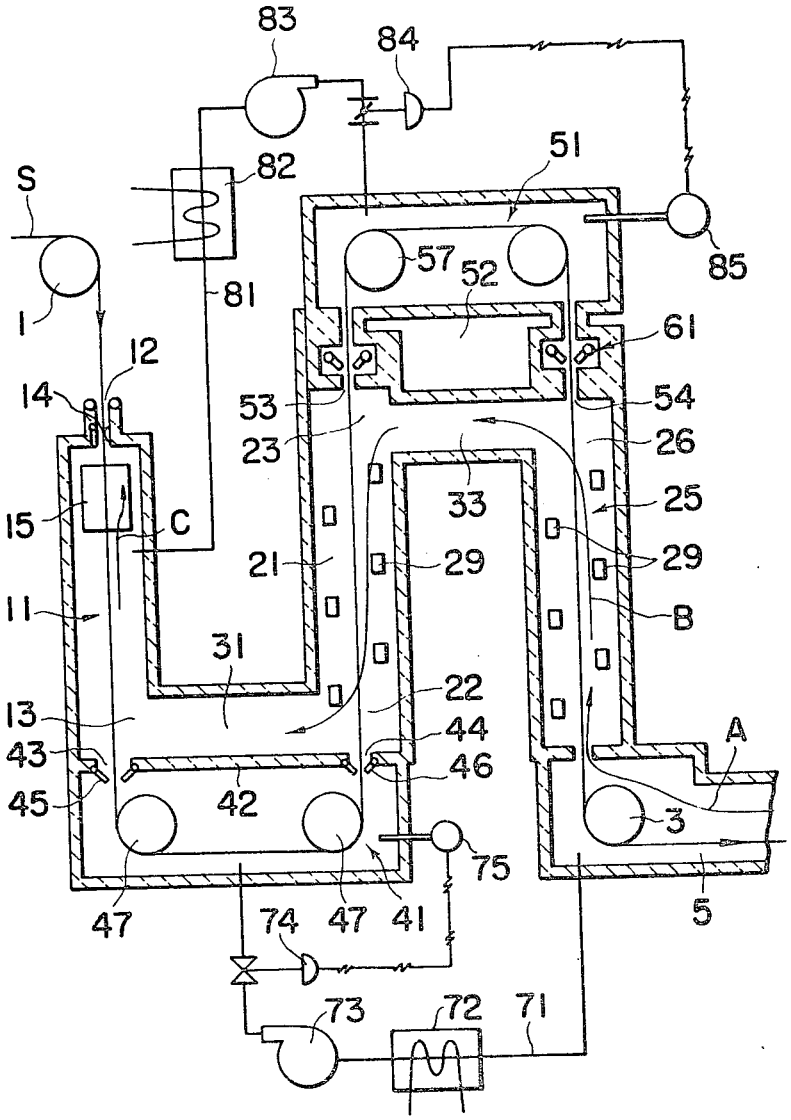
FIG. 1 is a cross-sectional elevation of one example of a vertical direct fired strip heating furnace according to the present invention.

The vertical direct fired strip heating furnace according to an embodiment of the present invention is constructed in such a way that there are provided two vertical direct fired strip heating chambers provided with top and bottom inside furnace rolls and a preheating chamber communicated with one of the heating furnace chambers to preheat the steel strip with the high temperature combustion product from the direct fired strip heating chamber. The top and bottom inside furnace rolls are separated from the main flow of the combustion gases, and the atmospheric temperature of the roll chambers housing the inside furnace rolls are controlled to a temperature above the temperature of the steel strip passing the roll chamber and also to a temperature below the combustion gas temperature (in the practice, below 1000° C.). A device for protecting the inside furnace rolls from the high temperature hot gasses is further provided, whereby the present invention is not limited to two direct fired strip heating chambers and one preheating chamber, and it is possible to provide one or more than three direct fired heating chambers depending on the required processing capacity. Also, it is possible to provide a plurality of preheating chambers to accomplish energy savings.

Embodiments of the present invention will be described in detail in the following by referring to the drawings.

In FIG. 1, there is shown preheating chamber (11) which is vertically and parallelly arranged in the order from the upstream side of the flow of strip S with two direct fired strip heating chambers (21), (25). The steel strip S passes a deflector roll (1) and passes sequentially through preheating chamber (11), direct fired strip heating chambers (21), (25), and also through a throat (5) and then moves through a heating reduction chamber (not shown). The combustion gases are made to flow in the directions A, B, C, opposite to the advancement of the strip S, by a blower (not shown) provided in the heating chamber disposed behind the direct fired strip heating chamber.

The preheating chamber (11) is provided at the inlet (12) thereof with a sealing device (14) consisting of two pieces of seal rolls capable of shifting with respect to the surface of the strip, and the sealing device prevents the emission of the combustion gases outside the furnace through the inlet (12). At a location immediately below the inlet (12), a combustion gas discharge port (15) is provided, and the combustion gases are discharged outside the building through a furnace pressure adjusting device and exhaust stack (not shown).

First direct fired strip heating chamber (21) and second direct fired strip heating chamber (25) succeeding the preheating chamber (11) are provided with a large number of burners (29) that open to the respective chambers, and the strip S is directly heated by the burners (29).

An inlet (22) of the first direct fired strip heating chamber (21) and an outlet (13) of the preheating chamber (11) are connected by a horizontally extending flue (31), and an outlet (23) of the first direct fired strip heating chamber (21) and an inlet (26) of the second direct fired strip heating chamber (25) are similarly connected by a flue (33). In these flues (31) and (33), only the combustion gases pass, and the strip S does not pass therethrough.

At the bottom side of the flue (31), a bottom roll chamber (41) is provided in parallel with the flue (31), and the bottom roll chamber (41) is separated from the preheating chamber (11), from the first direct fired strip heating chamber (21), and from flue (31) by a partition (42). The partition (42) is provided with a narrow passage (43) for passing the strip S and which opens to the outlet (13) of the preheating chamber (11) and a similar passage (44) that opens to the first direct fired strip heating chamber (21). Water cooling dampers (45) and (46) are provided on the passages (43) and (44) and are rotatable around horizontal axes to adjust the openings of the passages. The water cooling dampers (45) and (46) are opened and closed by manipulation from outside the furnace.

Below the passages (43) and (44) are provided a pair of guide rolls (47), each for changing the advancing direction of the strip S by 90°, and this pair of guide rolls (47) can be rotatably driven by a drive device (not shown).

At the top side of the flue (33), a top roll chamber (51) similar to the bottom roll chamber (41) is provided, and the top roll chamber (51) is separated from the first direct fired strip heating chamber (21), from the second direct fired strip heating chamber (25) and from flue (33) by a partition (52). The partition (52) is provided with passages (53) and (54), and a pair of guide rolls (57) are housed in the top roll chamber (51).

Figure 2:
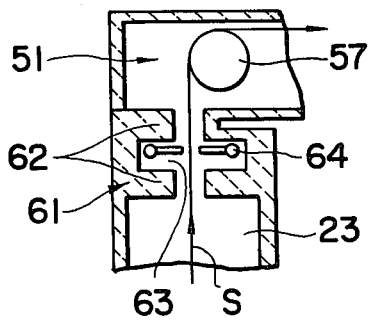
FIG. 2 is a cross-section showing one example of a shielding device for separating the roll chamber from the direct fired strip heating chamber.

In order to separate the top roll chamber (51) more positively, as shown in FIG. 2, it is preferable to provide a throat portion (62) and a shielding device (61) including a water cooling damper (64) provided in a space (63) formed between the throats. The throat portion (62) preferably provides as small a gap as possible to the surface of the strip S, but when workability at the threading operation of the strip is taken into consideration, it is desirable to maintain about 100 mm at one side. Accordingly, in order to minimize the radiation heat entering the roll chamber (51) from the high temperature heating chambers (21) and (25) and to minimize the inflow of the combustion gases, it becomes effective to provide the openable water cooling damper (64). Also, instead of the water cooling damper (64), it is effective to employ a system wherein an openable gas blowing nozzle is provided to produce a gas curtain effect.

The gap from the surface of the strip when the water cooling damper (64) or the gas blowing nozzle is closed is preferably maintained at about 25 mm for one side when presence of the wave of the strip is taken into consideration. Accordingly, at the time of threading of the strip, the water cooling damper or the gas blowing nozzle must be opened to facilitate an easy threading operation. Although it is preferable to provide a similar throat portion between the bottom roll chamber (41), heating chamber (21) and preheating chamber (11), in the present invention the throat portion is not provided, to thus facilitate the operation of drawing out the strip outside the furnace at the time of breaking of the strip. The openable water cooling dampers (45) and (46) are provided to limit to a minimum the amounts of the radiation heat and of the combustion gases entering and flowing into chamber (41). The water cooling dampers (45) and (46) installed in the bottom roll chamber (41) are basically the same as top damper (64), but consideration of enlarging the opening is required as compared with the time when the furnace is opened to remove the strip.

The bottom partition (42) prevents the high temperature gas from entering the bottom roll chamber (41), and the gas temperature in chamber (41) is maintained at a slightly higher desired temperature to minimize the thermal stress generated in the body of the rolls by connecting chamber (41) with a heating and reducing chamber and the throat (5) by a duct (71). The duct (71) is provided with a heat exchanger (72) for cooling the combustion gases to a proper temperature, a blower (73) for blowing the combustion gases into the bottom roll chamber (41), and an adjusting valve (74) for adjusting the combustion gas flowrate. The flowrate adjusting valve (74) is controlled by a temperature detecting controlling device (75) which detects the temperature in the bottom roll chamber (41) and controls valve (74).

Similarly, the top roll chamber (51) is connected with the preheating chamber (11) by a duct (81) having therein a heat exchanger (82), blower (83) and flowrate adjusting valve (84). The flowrate adjusting valve (84) is controlled by a temperature detecting controlling device (85) provided in the top roll chamber (51).

Figure 3:
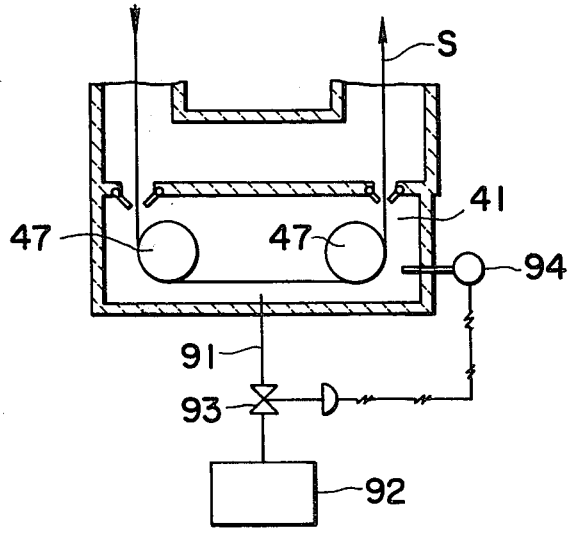
FIG. 3 is a schematic view of another example of the device for adjusting the temperature in the roll chamber.

The high temperature gases to be supplied to the bottom roll chamber (41) or the top roll chamber (51) are extracted from the respective proper positions in the furnace, and this feature is not limited to the illustrated embodiment, but rather gases supplied from outside the furnace may also be used. FIG. 3 shows this kind of arrangement, and a vessel (92) filled with the properly heated and pressurized gases and the bottom roll chamber (41) are connected by a duct (91) having therein a flowrate adjusting valve (93), and the flowrate adjusting valve (93) is controlled by a temperature detecting controlling device (94). The bottom roll chamber (41) is maintained at a proper temperature by the high temperature gases from the vessel (92).

In the example shown in the drawings, two heating chambers (21) and (25) and one preheating chamber (11) are provided, and throat portions for the protection of the rolls are installed only for the top roll chamber (51), but the present invention is not limited to this specific example, and it is needless to say that more than two heating chambers, and more than two preheating chambers as well as a throat portion (62) for each roll chamber may be provided.

Although the present invention has been described in the foregoing, the operation of the apparatus will now be explained in the following. The strip S enters a preheating chamber (11) from an inlet seal device (14) by means of a deflector roll (1), and is preheated to about 200° C. by combustion gas of about 1000° C. flowing from the heating chamber (21), and then is heated to about 450° C. by the high temperature gases of 1000° C. to 1150° C. in the first direct fired strip heating chamber (21) ranging from the bottom roll (47) in the bottom roll chamber (41) to the top roll (57) in the top roll chamber (51), and then again is heated to about 650° C. by the high temperature gases of 1150° C. to 1200° C. in the second vertical direct fired heating chamber (25) ranging from the top roll (57) to the bottom roll (47), and then is fed to a successive indirect heating and reducing chamber.

The major portion of the combustion gases generated in the vertical direct fired strip heating chambers, as shown by Arrows A, B, C, does not enter the separate top and bottom roll chambers, but is discharged outside the furnace through the discharge port (15) after passing through flues (31) and (33).

Particularly, as shown in FIG. 2, if a protecting device is provided in a communicating portion of the heating chamber and roll chamber, it is possible to shield the radiation heat almost completely, and if necessary, the temperature in the roll chambers can be adjusted by the heat exchangers (72, 82) and blowers (73, 83), and abnormal temperature increases in the roll chambers can be prevented.

Remarkable effects to be obtained by the present invention are enumerated in the following.

(1) In the conventional vertical continuous zinc plating installation, the processing capacity is limited to about 30 tons per hour in a single chamber vertical direct fired strip heating furnace due to a limit of furnace height on grounds of construction cost and operating technique. However, according to the foregoing embodiment of the present invention, it is possible to construct a large size installation which has processing capacity of 140 tons per hour while maintaining an economical flame cleaning process. An even larger capacity installation can be constructed by connecting the direct fired heating chambers.

(2) It becomes possible to connect the preheating chamber to the entry side of the heating chamber, and the strip is not exposed to the atmosphere through the connection with the preheating chamber, thus making possible the preheating of the strip to high temperatures.

As a result, in the prior art, in comparison with the case where there is no preheating chamber, a reduction of fuel consumption of only about 15–20% is achieved, but by the method of the present invention, with the heating chamber connected to a preheating chamber of the same height as the heating chamber, fuel savings 40% or more can be accomplished.

(3) In the large capacity processing furnace, the space for the installation becomes smaller.

Namely, in indirect strip heating, due to a limit of heat resisting material, a maximum surface temperature is about 950° C., and in case of the direct fired strip heating, gas temperature (furnace temperature) is set at 1200° C., and also the coefficient of heat-transfer related to radiation heat-transfer is $\phi_{CH}=0.25$ in case of the indirect heating, and in case of the direct fired strip heating, $\phi_{CG}=0.4$–$0.45$, whereby the ratio of effective heating length is:

$$\frac{\text{indirect heating}}{\text{direct heating}} \longrightarrow \frac{\left(\frac{950+273}{100}\right)^4-\left(\frac{700+273}{100}\right)^4}{\left(\frac{1200+273}{100}\right)^4-\left(\frac{700+273}{100}\right)^4}\times\frac{0.25}{0.45}=\frac{1}{2.84}\times\frac{1}{1.8}=\frac{1}{5.11}$$

and as a result, it becomes about one fifth.

As a more concrete example of the above, assume the example of a continuous annealing furnace for zinc plating having a maximum processing capacity of 140 ton/hour as mentioned in the foregoing, and in case the flame cleaning process is employed and the vertical direct fired strip heating furnace according to the illustrated embodiment of the present invention is employed, assume that the steel strip is heated up to 650° C. in the direct fired strip heating furnace, and then in the succeeding indirect heating and reducing zone, it is heated up to 750° C., a total number of strip strands becomes nine strands, but in case an electric cleaning process is employed and all the operations are accomplished by the indirect heating method, it becomes sixteen strands.

Also, the length of the entire heating zone can be shortened by 20%.

(4) In a large capacity processing furnace, the mill oil on the surface of the strip can be subjected to flame cleaning, and the electric cleaning installation can be eliminated.

(5) With the addition of the effective inside furnace roll protecting device, it becomes possible to use plain ordinary heat resisting alloy rolls.

It is to be understood that the apparatus according to the present invention can be applied to continuous annealing furnaces for all kinds of steel sheets.

What is claimed is:

1. In a vertical direct fired strip heating furnace for heating steel strips and of the type including at least two vertical and parallelly arranged heating chambers each having strip entrance and exit ends, with a steel strip to be heated passing in a vertical path through the entrance and exit ends of an upstream-most said heating chamber and then in successive vertical paths through the entrance and exit ends of the remainder of said heating chambers, and guide rolls located adjacent the exit end of said upstream-most heating chamber and adjacent the entrance and exit ends of said remainder of said heating chambers, at least the downstream-most of said heating chambers being provided therein with burners to directly heat the steel strip passing therethrough, the improvement comprising:

a horizontal flue connecting a said exit end and an adjacent said entrance end of successive adjacent of said heating chambers;

adjacent each said horizontal flue and separate therefrom, a respective guide roll chamber housing the respective said guide rolls adjacent the said ends of said heating chambers connected by the respective said horizontal flue;

said steel strip passing horizontally through each said guide roll chamber but not through said horizontal flues, and said horizontal flues providing free communication of exhaust gases from said burners between said heating chambers, but said exhaust gases being substantially isolated from said guide roll chambers; and means for adjusting the temperature within said guide roll chambers.

2. The improvement claimed in claim 1, wherein at least two of said heating chambers are provided therein with said burners.

3. The improvement claimed in claim 1, wherein said upstream-most heating chamber comprises a preheating chamber which is free of said burners and which preheats the steel strip by means of combustion gases from other of said heating chambers provided therein with said burners, said combustion gases entering said preheating chamber through the respective said horizontal flue connected to said exit end thereof.

4. The improvement claimed in claim 3, wherein said preheating chamber has therein, at a position adjacent said entrance end thereof, a discharge port for the exit of said combustion gases.

5. The improvement claimed in claim 1, wherein said temperature adjusting means comprises, for each said guide roll chamber, a duct connecting one of said heating chambers with said guide roll chamber and for thus conveying combustion gases within said one heating chamber to said guide roll chamber, a heat exchanger in said duct for cooling said combustion gases to a desired temperature, a flow rate adjusting valve in said duct for adjusting the rate of flow of said combustion gases to said guide roll chamber, and detecting means connected to said adjusting valve for detecting the temperature within said guide roll chamber and for controlling said adjusting valve as a function of the detected temperature, to thereby adjust the temperature within said guide roll chamber.

6. The improvement claimed in claim 1, wherein said temperature adjusting means comprises a pressurized and temperature controlled source of gas, a duct connecting said gas source with each said guide roll chamber, a flow rate adjusting valve in said duct for adjusting the rate of flow of said gas from said source to said guide roll chamber, and detecting means connected to said adjusting valve for detecting the temperature within said guide roll chamber and for controlling said adjusting valve as a function of the detected temperature, to thereby adjust the temperature within said guide roll chamber.

* * * * *